US009054467B2

(12) United States Patent
Hamner et al.

(10) Patent No.: US 9,054,467 B2
(45) Date of Patent: Jun. 9, 2015

(54) ELECTRICAL CONNECTOR HAVING A CONNECTOR SHROUD

(71) Applicant: Tyco Electronics Corporation, Berwyn, PA (US)

(72) Inventors: Richard Elof Hamner, Hummelstown, PA (US); Christopher David Ritter, Hummelstown, PA (US); Jeffrey Byron McClinton, Harrisburg, PA (US); Justin Shane McClellan, Camp Hill, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 55 days.

(21) Appl. No.: 14/051,949

(22) Filed: Oct. 11, 2013

(65) Prior Publication Data

US 2015/0104977 A1 Apr. 16, 2015

(51) Int. Cl.
*H01R 12/71* (2011.01)

(52) U.S. Cl.
CPC ..... *H01R 12/716* (2013.01)

(58) Field of Classification Search
USPC ..... 439/607.05, 607.07, 685, 465, 607.08, 439/701, 717
See application file for complete search history.

(56) References Cited

U.S. PATENT DOCUMENTS

| | | | | |
|---|---|---|---|---|
| 7,195,519 | B1 * | 3/2007 | McAlonis et al. | 439/607.39 |
| 7,976,318 | B2 * | 7/2011 | Fedder et al. | 439/79 |
| 8,016,616 | B2 * | 9/2011 | Glover et al. | 439/607.05 |
| 8,167,651 | B2 * | 5/2012 | Glover et al. | 439/607.08 |
| 8,187,035 | B2 * | 5/2012 | Davis et al. | 439/607.02 |
| 8,251,745 | B2 * | 8/2012 | Johnescu et al. | 439/607.1 |
| 8,371,876 | B2 * | 2/2013 | Davis | 439/607.07 |
| 8,475,209 | B1 * | 7/2013 | Whiteman et al. | 439/607.07 |
| 8,500,487 | B2 * | 8/2013 | Morgan et al. | 439/607.06 |
| 8,579,636 | B2 * | 11/2013 | Davis et al. | 439/65 |
| 8,597,052 | B2 * | 12/2013 | Davis et al. | 439/607.08 |
| 8,690,604 | B2 * | 4/2014 | Davis | 439/607.07 |
| 8,771,016 | B2 * | 7/2014 | Atkinson et al. | 439/607.07 |
| 8,777,663 | B2 * | 7/2014 | Annis et al. | 439/607.05 |
| 8,894,442 | B2 * | 11/2014 | McClellan et al. | 439/607.05 |
| 2015/0024635 | A1 * | 1/2015 | McClellan et al. | 439/629 |

* cited by examiner

*Primary Examiner* — Alexander Gilman

(57) ABSTRACT

Electrical connector including a module assembly having a contact module. The contact module has a module body and signal conductors held by the module body. The module assembly has a shroud-engaging face. The signal conductors have respective signal members disposed along the shroud-engaging face. The electrical connector also includes a connector shroud that couples to the module assembly. The connector shroud has a mating side, a loading side, and a mating axis extending therebetween. The connector shroud includes contact passages that extend therethrough. The loading side interfaces with the shroud-engaging face. The connector shroud couples to the module assembly in first or second rotational positions about the mating axis. The contact passages align with the signal members for each of the first and second rotational positions.

20 Claims, 6 Drawing Sheets

ELECTRICAL CONNECTOR HAVING A CONNECTOR SHROUD

BACKGROUND

The subject matter herein relates generally to electrical connectors that are configured to transmit data signals.

Electrical connectors may be used within communication systems, such as telecommunication equipment, servers, data storage, transport devices, and the like. Some communication systems include daughter card assemblies, which may be communicatively coupled to each other through a midplane assembly. Other communication systems may communicatively couple daughter card assemblies directly to a backplane assembly. Each of the daughter card assemblies includes a receptacle connector that is mounted to a daughter card, such as a circuit board. In this example, one of the daughter card assemblies may be a line card assembly and the other daughter card assembly may be a switch card assembly. The midplane assembly includes a pair of header connectors that are mounted on opposite sides of a midplane circuit board. Each of the receptacle connectors of the daughter card assemblies mates with a different one of the header connectors thereby communicatively coupling the pair of daughter card assemblies through the midplane assembly. In this configuration, each of the receptacle connectors and the header connectors is aligned along a common mating axis.

Sometimes the receptacle connectors of the communication system have an orthogonal spatial relationship such that one of the receptacle connectors is rotated 90° (or −90°) about the mating axis. In this case, one daughter card assembly is rotated about the central axis by 90°. For many applications, however, the daughter cards are offset with respect to the mating axis. Thus, the location of the daughter card within the communication system depends upon which direction the daughter card assembly is rotated about the mating axis. More specifically, using the above example, if the daughter card assembly is rotated 90°, the daughter card will be offset with respect to the mating axis in one direction, but if the daughter card assembly is rotated −90° (or 270°), the daughter card will be offset with respect to the mating axis in an opposite direction.

When reconfiguring communication systems, it may be desirable to change the position of the daughter card such that the daughter card is offset with respect to the mating axis in a different direction. The daughter card may be re-positioned by modifying or replacing the header connector of the midplane (or backplane) assembly or by modifying or replacing the receptacle connector of the daughter card assembly. Reconfiguring the header connector and/or receptacle connector, however, may be costly and difficult to accomplish. For instance, header connectors and receptacle connectors are typically only capable of mating with the other connector in one orientation.

Accordingly, there is a need for an electrical connector that is capable of mating with a corresponding electrical connector at different rotational positions.

BRIEF DESCRIPTION

In one embodiment, an electrical connector is provided that includes a module assembly having a contact module. The contact module has a module body and signal conductors held by the module body. The signal conductors form differential signal pairs. The module assembly has a shroud-engaging face. The signal conductors have respective signal members disposed along the shroud-engaging face. The electrical connector also includes a connector shroud that couples to the module assembly. The connector shroud has a mating side and an opposite loading side with a mating axis extending therebetween. The connector shroud includes contact passages extending therethrough between the mating and loading sides. The loading side interfaces with the shroud-engaging face when the connector shroud is coupled to the module assembly. The connector shroud couples to the module assembly in a first rotational position or in a second rotational position with respect to the mating axis. The contact passages align with the signal members for each of the first and second rotational positions.

In some embodiments, the contact passages form a passage array. The passage array may have a rotational symmetry in which the passage array has an effectively identical configuration for the first and second rotational positions.

In another embodiment, an electrical connector is provided that includes a module assembly having a contact module. The contact module has a module body and signal conductors and ground members that are held by the module body. The module assembly has a shroud-engaging face. The signal conductors have corresponding signal members. The ground members and the signal members are disposed along the shroud-engaging face and collectively form at least a portion of a communication array. The electrical connector also includes a connector shroud that couples to the module assembly. The connector shroud has a mating side, a loading side, and a mating axis extending therebetween. The connector shroud includes contact passages extending therethrough between the mating and loading sides. The loading side interfaces with the shroud-engaging face when the connector shroud is coupled to the module assembly. The connector shroud is configured to removably couple to the module assembly in first or second rotational positions about the mating axis. The contact passages align with the ground members and the signal members of the communication array for each of the first and second rotational positions.

In certain embodiments, the communication array includes a plurality of member sub-arrays. Each of the member sub-arrays may include a pair of the signal members configured as a differential pair and a plurality of the ground members that are located around the pair of signal members.

In yet another embodiment, an electrical connector is provided that includes a connector shroud having a mating side, a loading side, and a mating axis extending therebetween. The connector shroud includes contact passages extending therethrough between the mating and loading sides. The electrical connector also includes a contact module having a module body and signal conductors held by the module body. The module body has a mating edge that interfaces with the loading side of the connector shroud and a mounting edge that is configured to engage a circuit board. The mating and mounting edges face in substantially perpendicular directions. The contact module includes a plurality of shroud-securing features, and the connector shroud includes a plurality of module-securing features that directly engage the shroud-securing features. The shroud-securing features have a rotational symmetry such that the shroud-securing features have substantially identical operative locations when the connector shroud is rotated 180° about the mating axis.

DETAILED DESCRIPTION

Figure 1:
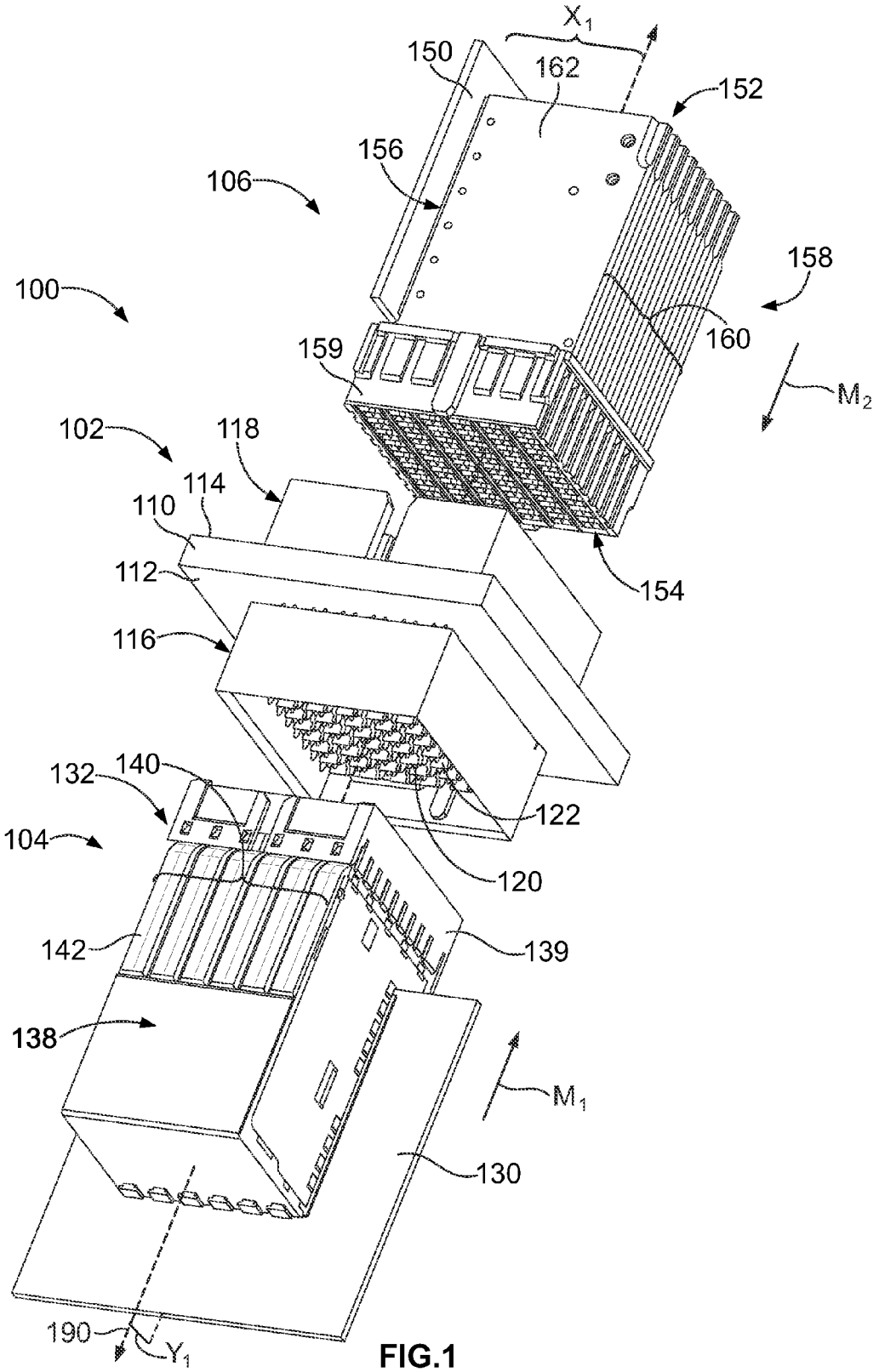
FIG. 1 is a perspective view of a communication system formed in accordance with one embodiment.

Embodiments described herein include communication systems that are configured to transmit data signals and electrical connectors and assemblies of such systems. The electrical connectors may include signal members and ground members that are positioned relative to one another to form a communication array. The communication array may be one-dimensional such that the array has one row or column of signal and ground members. The communication array may also be two-dimensional such that the array has multiple rows and columns of signal and ground members. In certain embodiments, the electrical connectors are receptacle connectors of a daughter card assembly and the mating connectors are header connectors of a backplane assembly. In other embodiments, the receptacle connectors may be part of the backplane assembly and the header connectors may be part of the daughter card assembly. The communication systems and the electrical connectors set forth herein may be configured for high-speed differential signal transmission, such as 10 Gbps, 20 Gbps, or more. However, it is understood that the electrical connectors described herein may be used in other applications that are not backplane systems or that are not high-speed signal transmission systems.

As set forth herein, the electrical connector may be configured to engage a mating connector at different rotational positions or orientations. For example, in some embodiments, the electrical connector may be configured to mate with the same mating connector at 0° rotation or at 180° rotation. In other embodiments, the electrical connector may be configured to mate with the mating connector at 0° rotation, 90° rotation, 180° rotation, or 270° rotation. However, the rotational positions are sufficiently separate and the total number of rotational positions may be finite. For example, the rotational positions may differ by at least 45° or 90°. More specifically, the electrical connector may not be capable of mating with the same mating connector at any rotational position.

To this end, one or more components of the communication systems described herein may have attachment features that are positioned to have a rotational symmetry for coupling to other components. As used herein, the term "rotational symmetry" refers to the component having an effectively identical arrangement or configuration of the attachment features whether in a first rotational position or in a second rotational position. As such, the component may couple to another component in each of the first and second rotational positions. Components described herein that may include attachment features that are located to have rotational symmetry include connector shrouds, module assemblies, and contact modules. The attachment features may include physically-defined structures that directly engage other physically-defined structures of the other component. For example, the attachment features may be projections or surfaces that define cavities for receiving projections. The attachment features may also be latches.

FIG. 1 is a perspective view of a communication system 100 formed in accordance with one embodiment. The communication system 100 includes a midplane (or backplane) assembly 102, a first daughter card assembly 104 configured to be coupled to one side of the midplane assembly 102, and a second daughter card assembly 106 configured to be connected to another side of the midplane assembly 102. The midplane assembly 102 is used to electrically connect the first and second daughter card assemblies 104, 106. The daughter card assemblies 104, 106 may be line cards or switch cards. In yet other embodiments, the daughter card assemblies 104, 106 may be part of a cabled midplane or backplane system. Alternatively, the daughter card assemblies 104, 106, with modification, may be directly connected to each other without the use of the midplane assembly 102. However, embodiments set forth herein may be used in other applications that are not midplane or backplane applications.

The midplane assembly 102 includes a midplane (or backplane) circuit board 110 having a first side 112 and second side 114 that face in opposite directions. The midplane assembly 102 includes a first header assembly 116 mounted to and extending from the first side 112 of the circuit board 110. The midplane assembly 102 includes a second header assembly 118 mounted to and extending from the second side 114 of the circuit board 110. The first and second header assemblies 116, 118 each include signal contacts 120 electrically connected to one another through the circuit board 110.

The backplane assembly 102 includes a plurality of signal pathways therethrough defined by the signal contacts 120 and conductive vias (not shown) that extend through the circuit board 110. Each signal pathway through the backplane assembly 102 is defined by a signal contact 120 of the first header assembly 116 and a signal contact 120 of the second header assembly 118.

The first and second header assemblies 116, 118 include ground shields 122 that provide electrical shielding around corresponding signal contacts 120. In an exemplary embodiment, the signal contacts 120 may be pin-like and arranged in pairs configured to convey differential signals. The ground shields 122 may have panels or sides that peripherally surround a corresponding pair of the signal contacts 120. For example, the ground shields 122 may be C-shaped or L-shaped.

The daughter card assembly 104 includes a first circuit board 130 and a first receptacle assembly 132 coupled to the circuit board 130. The receptacle assembly 132 is configured to be coupled to or mate with the first header assembly 116.

The receptacle assembly 132 includes a connector body 138 that is formed from a connector shroud 139 and a module assembly 140 that is coupled to the connector shroud. The module assembly 140 has a plurality of contact modules 142 that are each coupled to and held by the shroud 139. The contact modules 142 are held in a stacked configuration in which each contact module 142 extends generally parallel to the other contact modules 142. The contact modules 142 hold a plurality of signal conductors (not shown) that are electrically connected to the circuit board 130 and partially define signal pathways through the receptacle assembly 132. The signal conductors are configured to be electrically connected to the signal contacts 120 of the first header assembly 116. The signal conductors may be arranged in pairs carrying differential signals.

The second daughter card assembly 106 includes a second circuit board 150 and a second receptacle assembly 152 coupled to the circuit board 150. The receptacle assembly 152 is configured to be coupled to the second header assembly 118. The receptacle assembly 152 has a mating side or face 154 configured to be mated with the second header assembly 118. The receptacle assembly 152 has a mounting side or face 156 configured to be mated with the circuit board 150. In an exemplary embodiment, the mounting side 156 is oriented perpendicular with respect to the mating side 154. When the receptacle assembly 152 is coupled to the second header assembly 118, the circuit board 150 is oriented perpendicular with respect to the circuit board 110. The circuit board 150 is also oriented perpendicular to the circuit board 130.

The receptacle assembly 152 includes a connector body 158 that is formed from a shroud 159 and a module assembly 160 having a plurality of contact modules 162 that are held by the shroud 159. The connector body 158 includes the mating and mounting sides 154, 156. The contact modules 162 are held in a stacked configuration generally parallel to one another. The contact modules 162 hold a plurality of signal conductors (not shown) that are electrically connected to the circuit board 150 and partially define signal pathways that extend through the receptacle assembly 152. The signal conductors are configured to be electrically connected to the signal contacts 120 of the second header assembly 118. In an exemplary embodiment, the contact modules 162 provide electrical shielding for the signal conductors.

The signal conductors may be arranged in pairs carrying differential signals. In an exemplary embodiment, the contact modules 162 generally provide 360° shielding for each pair of signal conductors along substantially the entire length of the signal conductors between the mounting side 156 and the mating side 154. The shield structure of the contact modules 162 that provides the electrical shielding for the pairs of signal conductors is electrically connected to the ground shields 122 of the second header assembly 118 and is electrically connected to a ground plane of the circuit board 150.

In the illustrated embodiment, the circuit board 130 is oriented generally horizontally. The contact modules 142 of the receptacle assembly 132 are oriented generally vertically. The circuit board 150 is oriented generally vertically. The contact modules 162 of the receptacle assembly 152 are oriented generally horizontally. As such, the daughter card assembly 104 and the daughter card assembly 106 have an orthogonal orientation with respect to one another.

As shown in FIG. 1, the daughter card assemblies 104, 106 have different rotational positions with respect to a central mating axis 190. In the illustrated embodiment, the mating axis 190 extends through respective centers of the header connector assemblies 116, 118 and respective centers of the receptacle assemblies 132, 152. The daughter card assembly 104 is configured to move in a respective mating direction $M_1$ along the mating axis 190, and the daughter card assembly 106 is configured to move in a respective mating direction $M_2$ along the mating axis 190 that is opposite the mating direction $M_1$. In the rotational positions shown in FIG. 1, the circuit boards 130, 150 are offset with respect to the mating axis 190 in different directions. More specifically, the circuit board 130 is offset with respect to the mating axis 190 by a distance Y, and the circuit board 150 is offset with respect to the mating axis 190 by a distance X. In the illustrated embodiment, the distances X and Y are substantially equal, but may be different in other embodiments.

Figure 3:
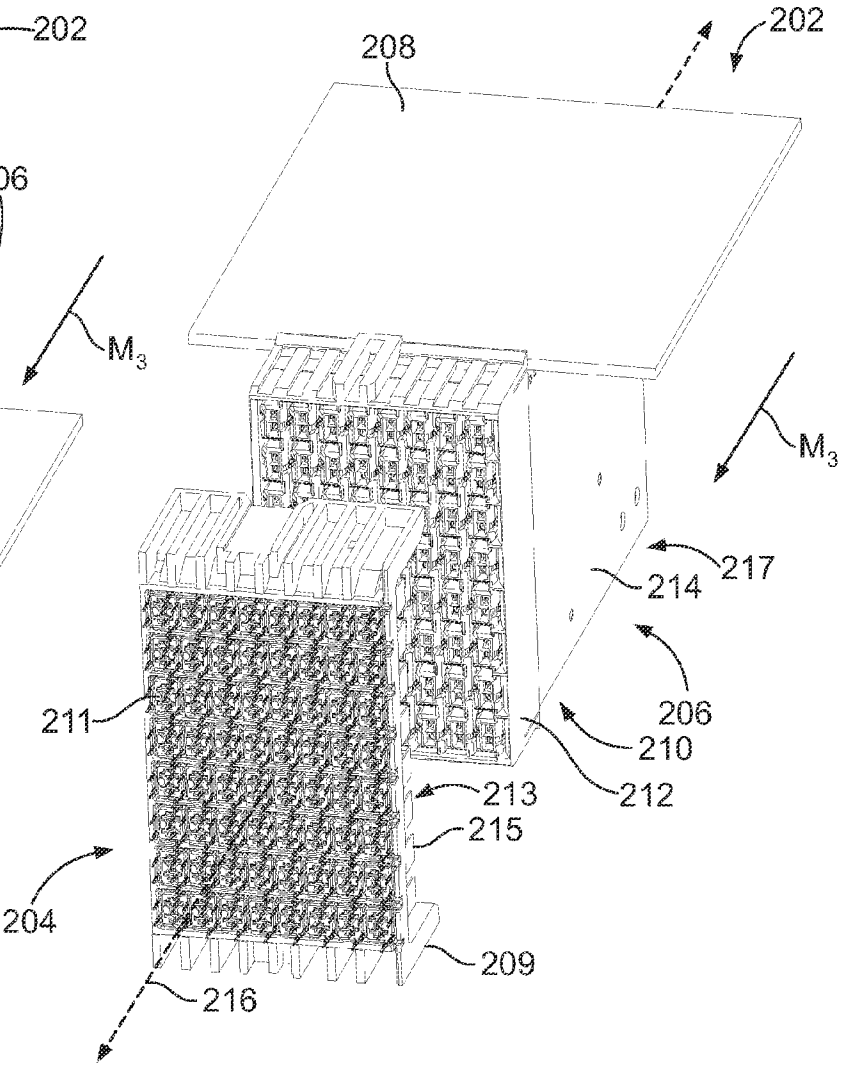
FIG. 3 is a perspective view of the electrical connector assembly in a second rotational position with respect to the mating connector.
Figure 2:
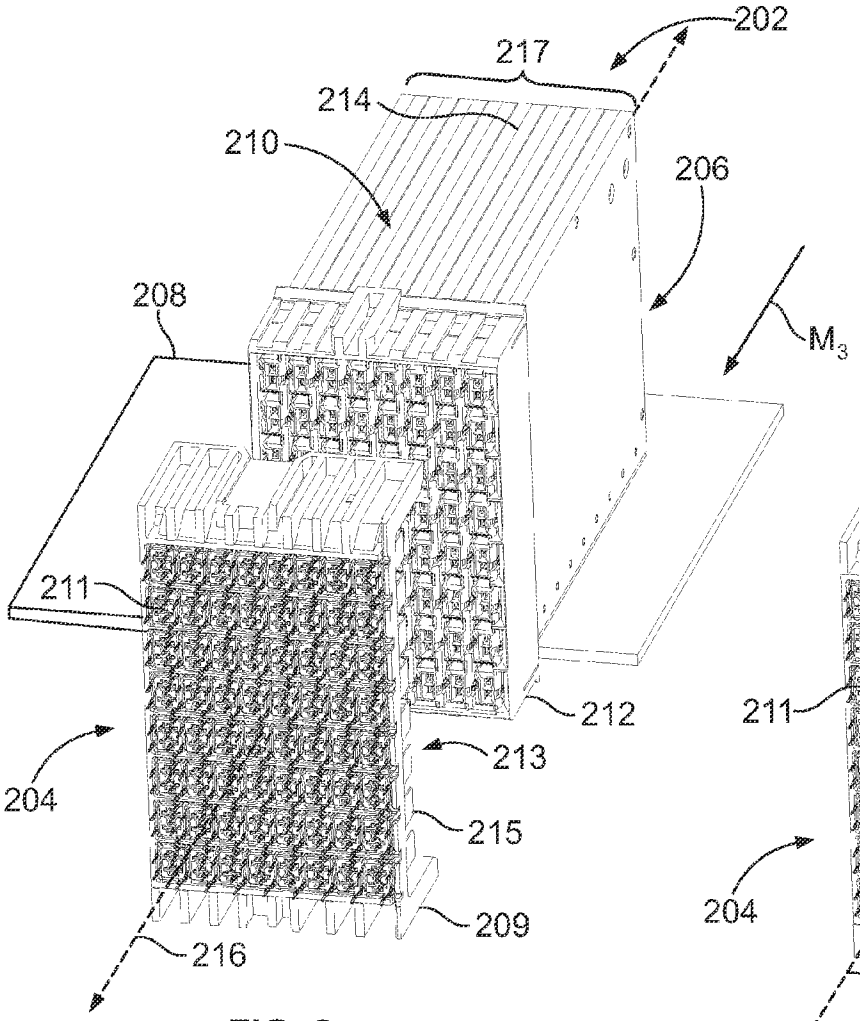
FIG. 2 is a perspective view of an electrical connector assembly according to one embodiment that is in a first rotational position with respect to a mating connector.

FIGS. 2 and 3 illustrate a daughter card assembly 202 in accordance with one embodiment. The daughter card assembly 202 may be similar to the daughter card assemblies 104, 106 (FIG. 1). In FIGS. 2 and 3, the daughter card assembly 202 has different rotational positions with respect to an electrical connector 204, which may be referred to herein as a header connector or a mating connector. The first rotational position is shown in FIG. 2 and represents a reference rotational position in which the daughter card assembly 202 has a rotational position of 0° rotation. The second rotational position is shown in FIG. 3 and includes the daughter card assembly 202 being rotated 180° about a central mating axis 216 with respect to the first rotational position. Thus, in the illustrated embodiment, the first and second rotational positions differ by 180°. However, as described herein, the first and second rotational positions may differ by other amounts in other embodiments, such as 90° or 270°.

The daughter card assembly 202 includes an electrical connector 206 (hereinafter referred to as a receptacle connector) and a circuit board 208 to which the receptacle connector 206 is mounted. The receptacle connector 206 includes a connector body 210 that is formed from a connector shroud 212 and a module assembly 217. The module assembly 217 may include a plurality of contact modules 214. In the illustrated embodiment, each of the contact modules 214 is coupled to the connector shroud 212. The contact module 214 may be similar to the contact modules 142, 162 (FIG. 1). In alternative embodiments, the module assembly 217 does not include separate contact modules. As shown, the mating axis 216 extends through the header connector 204 and through the receptacle connector 206. In some embodiments, the header connector 204 may be secured to another circuit board (not shown), such as a backplane circuit board. Thus, to mate the receptacle connector 206 and the header connector 204, the receptacle connector 206 may be moved in a mating direction $M_3$ along the mating axis 216.

The header connector 204 includes a connector housing 209 and an array of header contacts 211 held by the connector housing 209. The header contacts 211 include contacts configured to transmit data signals (referred to as "signal contacts") and contacts that may be used to shield the signal contacts (referred to as "ground contacts" or "ground shields"). The header connector 204 includes a connector-receiving space 213 that is configured to receive the receptacle connector 206 during a mating operation. The header contacts 211 extend through the connector housing 209 into the connector-receiving space 213. In addition to the header contacts 211, the connector housing 209 may include portions that are conductive and that electrically connect to the receptacle connector 206. The header connector 204 may also include ground shields 215. In the illustrated embodiment, the ground shields 215 are located along one side of the header connector and extend lengthwise along the mating axis 216. The ground shields 215 are configured to engage portions of the receptacle connector 206.

In FIGS. 2 and 3, the connector shroud 212 is coupled to the module assembly 217 and facilitates holding the contact modules 214 together as a single or unitary structure. In some embodiments, the connector shroud 212 is removably coupled to the module assembly 217 such that the connector shroud 212 may be readily separated and re-attached to the module assembly 217 without undue effort. For example, the connector shroud 212 may be attached to the module assembly 217 without using a tool and/or without using hardware, such as screws or bolts.

To change the rotational position of the daughter card assembly 202 (or the module assembly 217), the connector shroud 212 may be decoupled from the module assembly 217. The connector shroud 212 and/or the module assembly 217 may be rotated relative to the other until the desired rotational position is achieved. The connector shroud 212 may then be re-coupled to the module assembly 217. In the illustrated embodiment, the daughter card assembly 202 is effectively rotated 180° about the mating axis 216 between the first and second rotational positions. As set forth below, the daughter card assembly 202 may be configured so that the daughter card assembly 202 is capable of mating with the header connector 204 at the first and second rotational positions.

Accordingly, the receptacle connector 206 or the daughter card assembly 202 is "rotated" when electrical components of the connector or daughter card assembly are rotated. Such electrical components include signal conductors, ground members, ground shields, circuit board, and the like. More specifically, it is recognized that the connector shroud 212 may have the same orientation in each of the first and second rotational positions of the receptacle connector 206 or the daughter card assembly 202.

Figure 4:
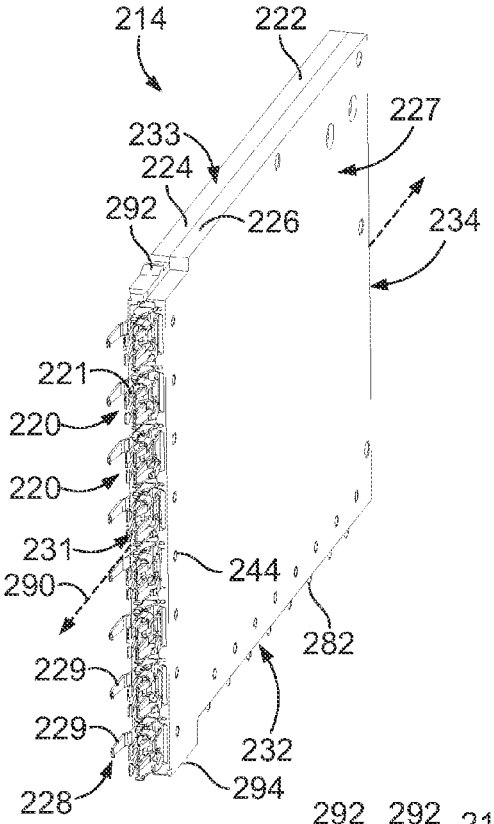
FIG. 4 is an isolated perspective view of a contact module that may be used with the electrical connector assembly.
Figure 5:
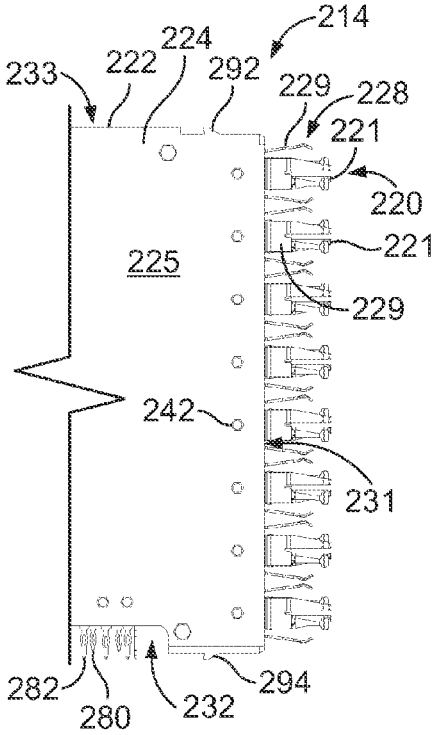
FIG. 5 is a partial side view of the contact module that may be used with the electrical connector assembly.

FIGS. 4 and 5 show an isolated perspective view and a side view, respectively, of one of the contact modules 214. The contact module 214 includes a plurality of signal conductors 220 and a module body 222 that holds the signal conductors 220. In some embodiments, the contact module 214 may also include ground conductors or shields 228. The module body 222 may have a plurality of edges 231-234 including a mating edge 231, a mounting edge 232, a module or top edge 233, and a module or rear edge 234 (FIG. 4). The signal and ground conductors 220, 228 may be exposed along the mating edge 231. For example, the signal conductors 220 include signal members 221 and the ground conductors 228 include ground members 229 that are exposed and configured to engage corresponding elements of the header connector 204 (FIG. 2). For some embodiments, the signal members 221 and ground members 229 may be contact beams, arms, or the like that are configured to flex between different positions.

In the illustrated embodiment, the module body 222 is formed from a first housing shell 224 and a second housing shell 226. For example, the housing shells 224, 226 may be coupled to each other with the signal conductors 220 and ground conductors 228 sandwiched therebetween. The housing shell 224 may define a first side surface 225 (FIG. 5) of the contact module 214, and the housing shell 226 may define a second side surface 227 (FIG. 4) of the contact module 214. In some embodiments, the housing shells 224, 226 may include reference elements 242, 244, respectively, that are configured to facilitate holding the housing shells 224, 226 together. Reference elements 242 and 244 may also be configured to facilitate holding the contact modules 214 together in a stacked configuration. For instance, the reference elements 242, 244 may be projections or recesses that are sized and shaped to mate with each other when two contact modules 214 are pressed side-by-side.

As shown, the contact module 214 has a right-angle configuration such that the mating edge 231 and the mounting edge 232 are substantially perpendicular to each other. The mating edge 231 includes a column of signal members 221 and ground members 229 that are configured to engage respective members of the header connector 204 (FIG. 2). The signal conductors 220 and the ground conductors 228 extend within the module body 222 between the mating and mounting edges 231, 232. As shown, the mounting edge 232 includes a plurality of signal members 280 (FIG. 5) and a plurality of ground members 282. The signal and ground members 280, 282 are electrically coupled to the signal and ground conductors 220, 228, respectively. The signal members 280 and the ground members 282 are configured to engage plated thru-holes of the circuit board 208 (FIG. 2).

The housing shells 224, 226 have shroud-securing features 292, 294, respectively. The shroud-securing features 292, 294 are configured to attach the contact module 214 to the connector shroud 212 (FIG. 2). For example, in the illustrated embodiment, the shroud-securing features 292, 294 are projections that extend away from the module edge 233 and the mounting edge 232, respectively, and are located proximate to the mating edge 231. However, the shroud-securing features 292, 294 may have different dimensions and locations in other embodiments. For example, the shroud-securing features 292, 294 may be surfaces of the module body 222 that form recesses configured to receive projections. In other embodiments, the shroud-securing features 292, 294 may be tabs or latches configured to couple to the connector shroud 212.

The shroud-securing features 292, 294 may be located with respect to a central module axis 290 so that the shroud-securing features 292, 294 have a rotational symmetry for coupling to the connector shroud 212. More specifically, the contact module 214 may be capable of coupling to the connector shroud 212 in a first rotational position or in a second rotational position. For example, the module axis 290 extends through a center of the contact module 214 as shown in FIG. 4. FIG. 4 shows the contact module 214 at 0° rotation. If the contact module 214 were rotated 180° about the module axis 290, the contact module 214 would still be capable of engaging the connector shroud 212 because the shroud-securing features 292, 294 would exchange relative positions. More specifically, the shroud-securing feature 292 has a first spatial position, and the shroud-securing feature 294 has a second spatial position. When the contact module 214 is rotated 180° about the module axis 290, the shroud-securing feature 292 would be located at the second spatial position and the shroud-securing feature 294 would be located at the first spatial position. Accordingly, in either of the rotational positions, such as 0° or 180°, the shroud-securing features 292, 294 have the same effective arrangement or configuration for coupling to the connector shroud 212. The configuration of the shroud-securing features 292, 294 may be described as having rotational symmetry about the module axis 290.

Figure 6:
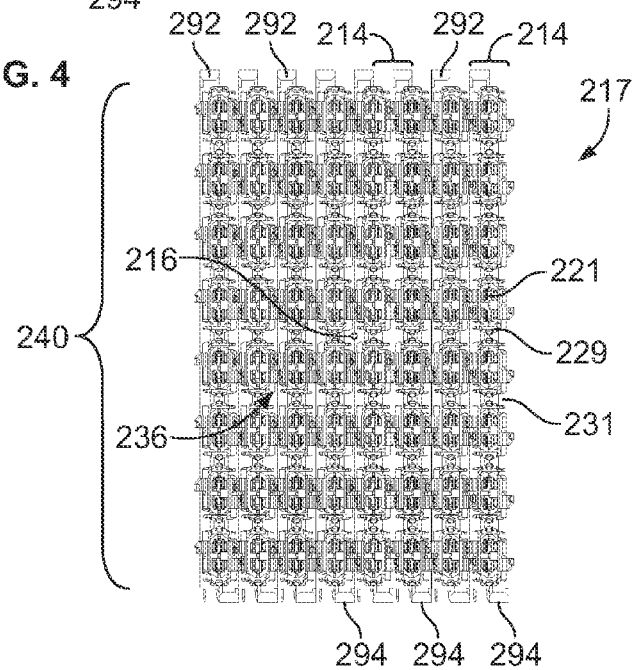
FIG. 6 is a front-end view of a module assembly that includes a plurality of the contact modules.

FIG. 6 is a front-end view of the module assembly 217 including the contact modules 214 stacked side-by-side. In the stacked arrangement, the side surface 225 (FIG. 5) of one contact module 214 interfaces with the side surface 227 (FIG. 4) of an adjacent contact module 214. When the contact modules 214 are arranged as shown in FIG. 6, the mating edges 231 collectively form a shroud-engaging face 236 of the module assembly 217. The signal members 221 and the ground members 229 may form a communication array 240. The signal members 221 and the ground members 229 may have designated locations or addresses with respect to one another in the communication array 240. The communication array 240 is configured to mate with a complementary array (not shown) of the header connector 204 (FIG. 2). In some embodiments, the communication array 240 includes a plurality of member sub-arrays 284 (FIG. 7) as described below.

In the illustrated embodiment, when the module assembly 217 is rotated 180° about the mating axis 216, the shroud-securing features 292 exchange relative positions with the shroud securing features 294. More specifically, the shroud securing features 292 move to the spatial positions of the shroud-securing features 294, and the shroud-securing features 294 move to the spatial positions of the shroud-securing features 292. As such, the contact modules 214 and/or the module assembly 217 may have multiple rotational positions with respect to the connector shroud 212 (FIG. 2) in which the connector shroud 212 is capable of coupling to the contact modules 214 or the module assembly 217. More specifically, the configuration of attachment features of the contact modules 214 and/or the module assembly 217 may have a rotational symmetry with respect to the mating axis 216 for coupling to the connector shroud 212 in multiple rotational positions.

Although the contact modules 214 and/or the module assembly 217 may have a rotational symmetry for coupling to the connector shroud 212, it should be noted that such rotational symmetry does not require all structural features of the contact modules 214 and/or the module assembly 217 to be symmetrical. For example, the module edge 234 (FIG. 4) may have structural features therealong that have no effect on whether the connector shroud 212 is capable of coupling to the contact module 214. As such, rotational symmetry refers only to the features that actively hold the components together, such as the shroud-engaging features 292, 294. Rotational symmetry may exist if the configurations are effectively or operationally the same before and after rotating.

Figure 7:
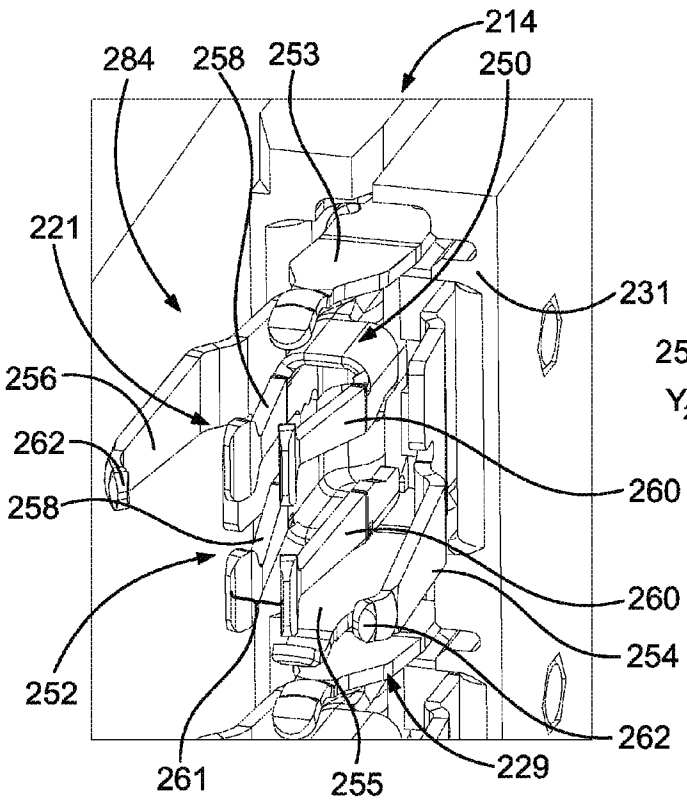
FIG. 7 is an enlarged perspective view of signal members and ground members that may be used with the electrical connector assembly of FIG. 2.

FIG. 7 is an enlarged perspective view of a portion of the mating edge 231 of the contact module 214 and illustrates a pair of the signal members 221 and a set of the ground members 229 in greater detail. The pair of signal members 221 and the set of the ground members 229 shown in FIG. 7 may constitute a single member sub-array 284. The pair of signal members 221 may also be referred to as a signal pair. As shown, the ground members 229 are distributed around the pair of signal members 221.

For clarity, the signal members 221 are referenced individually as signal members 250, 252 and the ground members 229 are referenced individually as ground members 253-256. As shown in FIG. 7, each of the signal members 250, 252 includes a pair of contact beams 258, 260. In an exemplary embodiment, the contact beams 258, 260 of one signal member are stamped and formed from a common piece of sheet metal. The contact beams 258, 260 are shaped to face each other with a contact-receiving space 261 therebetween. As shown, the signal members 250, 252 are positioned adjacent to each other without any ground members positioned therebetween. In certain embodiments, the signal members 250, 252 are capable of transmitting differential signals through the contact module 214.

Also shown in FIG. 7, the ground members 253, 256 are stamped and formed from a common piece of sheet metal, and the ground members 254, 255 are stamped and formed from a common piece of sheet metal. In the member sub-array 284, the ground members 253-256 are shaped to collectively surround the signal members 250, 252 and electrically isolate or shield the signal members 250, 252 from other sources of electromagnetic interference. For example, the signal members 250, 252 form differential signal paths that are isolated from other differential signal paths by the set of ground members 253-256. In particular embodiments, the ground members 253, 256 are shaped relative to each other to partially surround the signal member 250, and the ground members 254, 255 are shaped relative to each other to partially surround the signal member 252.

In some embodiments, each of the ground members 253-256 may be an elongated beam. Like the contact beams 258, 260, the ground members 253-256 may be configured to engage a corresponding member of the header connector 204 (FIG. 2) and be deflected to a different position. The ground members 253-256 are configured to be deflected in inward directions toward the signal member 250 or the signal member 252. The ground members 253-256 include distal ends 262. In some embodiments, the distal ends 262 are curved inward.

Figure 8:
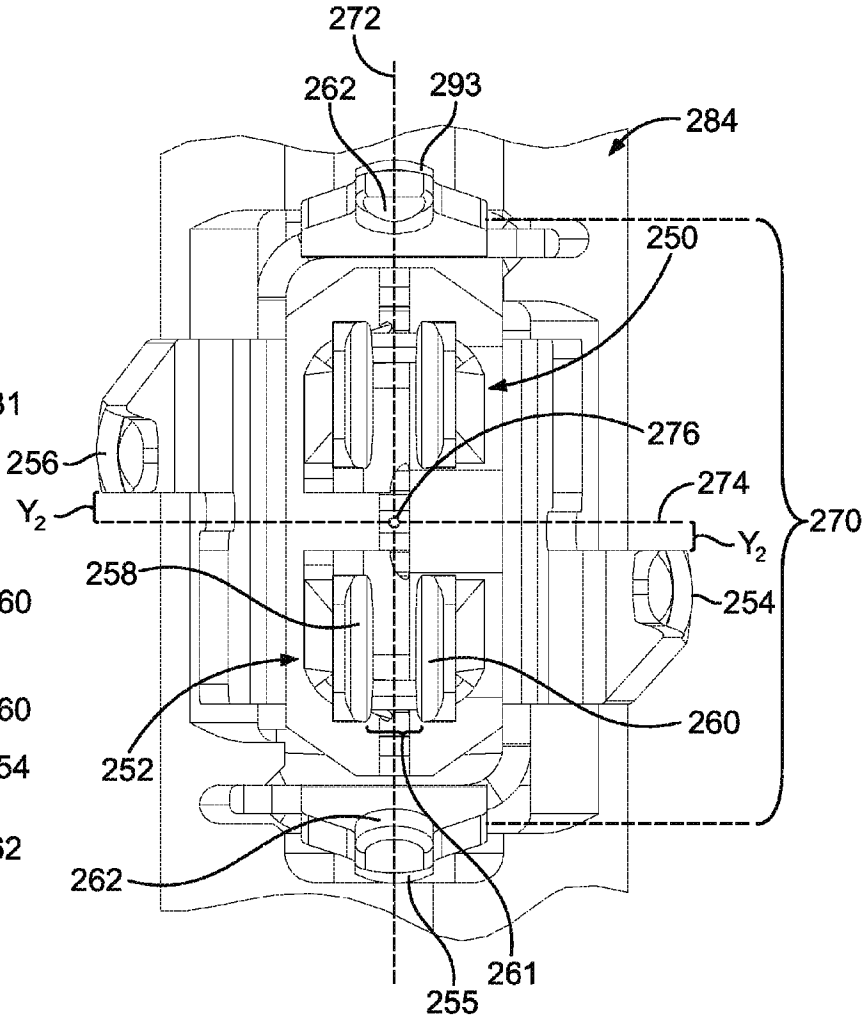
FIG. 8 is an enlarged front-end view of the signal members and the ground members that may be used with the electrical connector assembly of FIG. 2.

FIG. 8 is a plan view of the signal members 250, 252 and the ground members 253-256. As shown, the ground members 253-256 surround a signal zone or space 270 with the signal members 250, 252 located therein. The signal zone 270 is defined between the ground members 253, 255 and between the ground members 254, 256. As set forth herein, the ground members 253-256 and the signal members 250, 252 may be positioned relative to one another to have a rotational symmetry between first and second rotational positions. For example, an operative configuration of the ground members 253-256 and the signal members 250, 252 may be effectively identical in the first and second rotational positions. In particular embodiments, the first and second rotational positions differ by about 180°.

As shown, cross planes 272, 274 extend perpendicular to and intersect each other at a geometric center line 276 of the signal zone 270. More specifically, the ground member 253 and the ground member 255 may be aligned along the cross plane 272. For each of the ground members 253, 255, the cross plane 272 may intersect a center portion of the distal end 262. The signal members 250, 252 are also substantially aligned along the cross plane 272. For each of the signal members 250, 252, the cross plane 272 may extend between the opposing contact beams 258, 260 through a center of the contact-receiving space 261.

Also shown, the cross plane 274 may divide the signal zone 270 such that the ground members 253, 256 and the signal member 250 are on one side of the cross plane 274 and the ground members 254, 255 and the signal member 252 are on the other side of the cross plane 274. As shown, each of the ground members 254, 256 is offset from the cross plane 274 by a common distance $Y_2$. However, the ground member 254 is spaced apart from the cross plane 274 in one direction, and the ground member 256 is spaced apart from the cross plane 274 in an opposite direction.

In some embodiments, the member sub-array 284 may present an effectively identical operative configuration or arrangement before and after the contact module 214 is rotated between the first and second rotational positions. More specifically, after rotation, the ground members 253 and 255 have exchanged (e.g., switched or traded) relative locations, and the ground members 254 and 256 have exchanged relative locations. After rotation, the signal members 250, 252 have exchanged relative locations. Effectively, the operative configuration or arrangement of the ground members 253-256 and the signal members 250, 252 in the first rotational position is the same as the operative configuration or arrangement of the ground members 253-256 and the signal members 250, 252 in the second rotational position. However, in the illustrated embodiment, it is understood that the member sub-array 284 will engage a different portion of the header connector 204 (FIG. 2) after the module assembly 217 (FIG.

2) is rotated. Also shown in FIG. 8, the member sub-array 284 is rotationally symmetric about the center line 276. More specifically, if the member sub-array 284 was rotated about the center line 276 by 180°, the different ground and signal members would exchange relative locations as described above.

Figure 9:
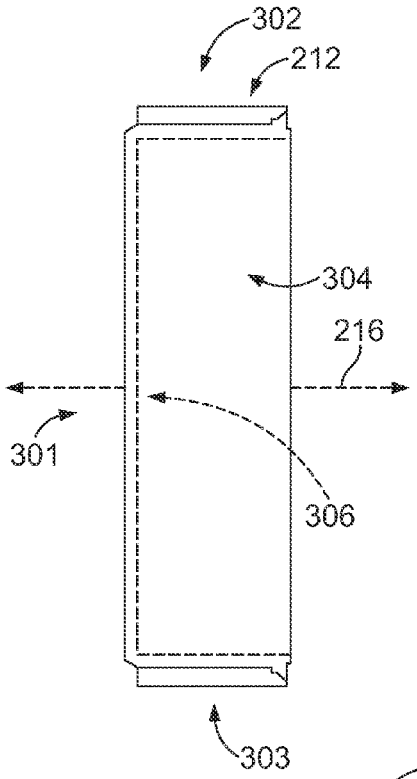
FIG. 9 is a side view of a connector shroud that may be used with the electrical connector assembly of FIG. 2.

FIG. 9 is a side view of the connector shroud 212. The connector shroud 212 has a mating side or face 301, coupling walls 302, 303, and an exterior wall 304. Although not shown, the connector shroud 212 may include another exterior wall that is opposite the exterior wall 304. The mating side 301 is configured to be received by the connector-receiving space 213 (FIG. 2) of the header connector 204 (FIG. 2). The coupling walls 302, 303 are configured to slide along and interface with interior sides or surfaces (not shown) that define the connector-receiving space 213. Also shown by the dashed or phantom lines in FIG. 9, the connector shroud 212 includes a loading side or face 306 that is opposite the mating side 301. During the mating operation, the mating axis 216 extends through the connector shroud 212 between the mating and loading sides 301, 306. The loading side 306 is configured to interface with the communication array 240 (FIG. 6) when the receptacle connector 206 (FIG. 2) is assembled. The loading side 306 also interfaces with the mating edges 231 (FIG. 4) and the shroud-engaging face 236 (FIG. 6) of the module assembly 217.

Figure 10:
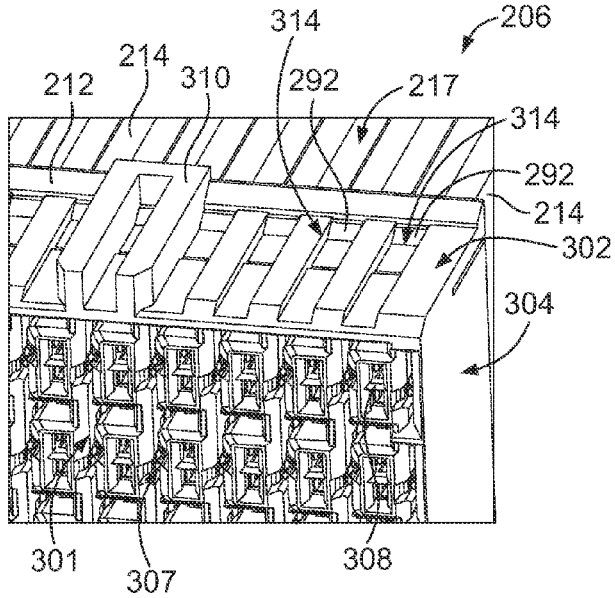
FIG. 10 is an enlarged front portion of the electrical connector assembly of FIG. 2.

FIG. 10 shows an enlarged portion of the receptacle connector 206 and, in particular, the mating side 301, the coupling wall 302, and the exterior wall 304 of the connector shroud 212. As shown, the mating side 301 includes a passage array 307 of contact passages 308. Each of the contact passages 308 extends between the mating side 301 and the loading side 306 (FIG. 9). The contact passages 308 align with and are configured to provide access to the signal and ground members 221, 229 (FIG. 4) of the communication array 240 (FIG. 6).

The coupling wall 302 may include keying features 310 that facilitate properly orienting the daughter card assembly 202 (FIG. 2) during a mating operation and aligning the connector shroud 212 with the header connector 204 (FIG. 2). In FIG. 10, the keying feature 310 is positioned along the coupling wall 302. A similar keying feature (not shown) may be positioned along the coupling wall 303 (FIG. 9). The keying features may be rotationally symmetric such that the keying features exchange positions with each other when the connector shroud 212 is rotated 180°.

In particular embodiments, the coupling wall 302 includes module-securing features 314, which define openings through the coupling wall 302 in the illustrated embodiment. The module-securing features 314 are configured to engage the shroud-securing features 292 to attach the connector shroud 212 to the module assembly 217. Although the coupling wall 303 is not shown, the coupling wall 303 may have identical features as the coupling wall 302.

As described herein, module-securing and shroud-securing features include physically-defined structures that directly engage other physically-defined structures in order to attach two components. For example, in the illustrated embodiment, the module-securing features 314 include surfaces that define openings or recesses for receiving the shroud-securing features 292 of the contact module 214. However, in other embodiments, the contact module 214 may include openings or recesses for receiving corresponding projections of the connector shroud 212. In alternative embodiments, either of the module-securing and shroud-securing features may be latches that directly engage surfaces of the other component. When the connector shroud 212 and the module assembly 217 are attached to each other, the module-securing features and the shroud-securing features may prevent movement of the module assembly 217 away from the connector shroud 212.

Figure 11:
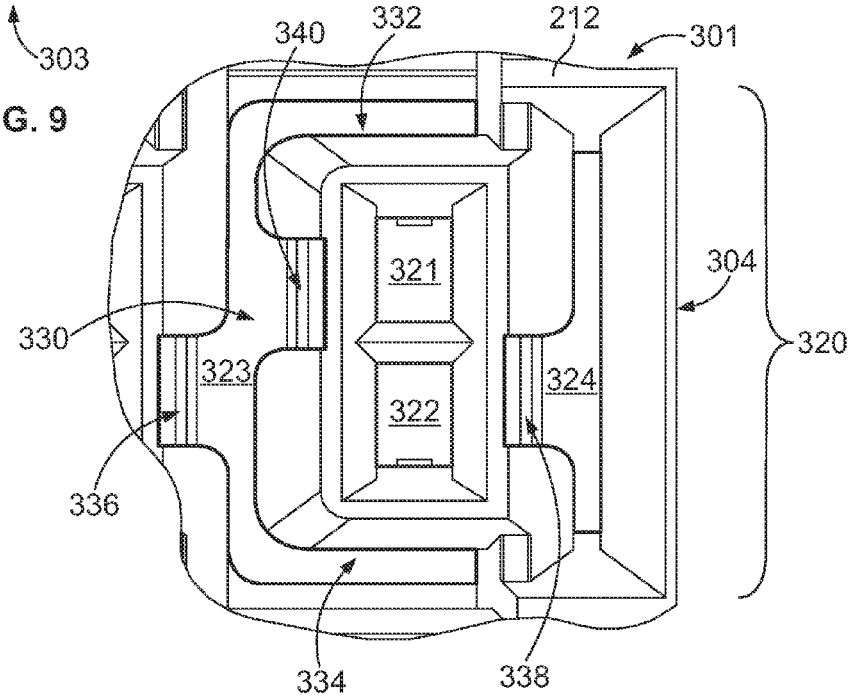
FIG. 11 is an enlarged front-end view of contact passages through the connector shroud.

FIG. 11 is an enlarged view of the mating side 301 of the connector shroud 212 illustrating a passage sub-array or set 320 of contact passages 321-324. The passage sub-array 320 is dimensioned to align with the member sub-array 284 so that the different members of the member sub-array 284 may be engaged during the mating operation. For illustrative purposes, the contact passages 321-324 are outlined in bold in FIG. 11. The contact passages 321-324 extend between the mating side 301 and the loading side 306 (FIG. 9). The portion of the mating side 301 shown in FIG. 11 includes the exterior wall 304. In an exemplary embodiment, the mating side 301 includes a total of eight sub-arrays along the exterior wall 304 that are similar or identical to the sub-array 320. In addition to the sub-arrays 320, the passage array 307 (FIG. 10) may also include other sub-arrays. For example, such sub-arrays may have contact passages that are similar to the contact passages 321-323, but not the contact passage 324.

The contact passages 321-324 include signal passages 321, 322 and ground passages 323, 324. The signal passages 321, 322 are centrally located within the sub-array 320. The ground passages 323, 324 substantially surround the signal passages 321, 322. For example, the ground passage 323 may be C-shaped and include a body portion 330, a leg portion 332, and a leg portion 334. The body portion 330 extends between and joins the leg portions 332, 334. The leg portions 332, 334 extend substantially parallel to each other. As such, the ground passage 323 partially surrounds the signal passages 321, 322. The ground passage 324 is substantially planar and extends parallel to the body portion 330 with the signal passages 321, 322 between. Accordingly, the ground passage 324 and the ground passage 323 substantially surround the signal passages 321, 322.

Also shown in FIG. 11, the ground passage 323 includes recesses 336, 340, and the ground passage 324 includes a recess 338. The recesses 338 and 340 extend generally toward the signal passages 321, 322. The recess 336 extends away from the signal passages 321, 322. Although not shown, the recess 336 may extend toward signal passages of an adjacent sub-array of contact passages.

Figure 12:
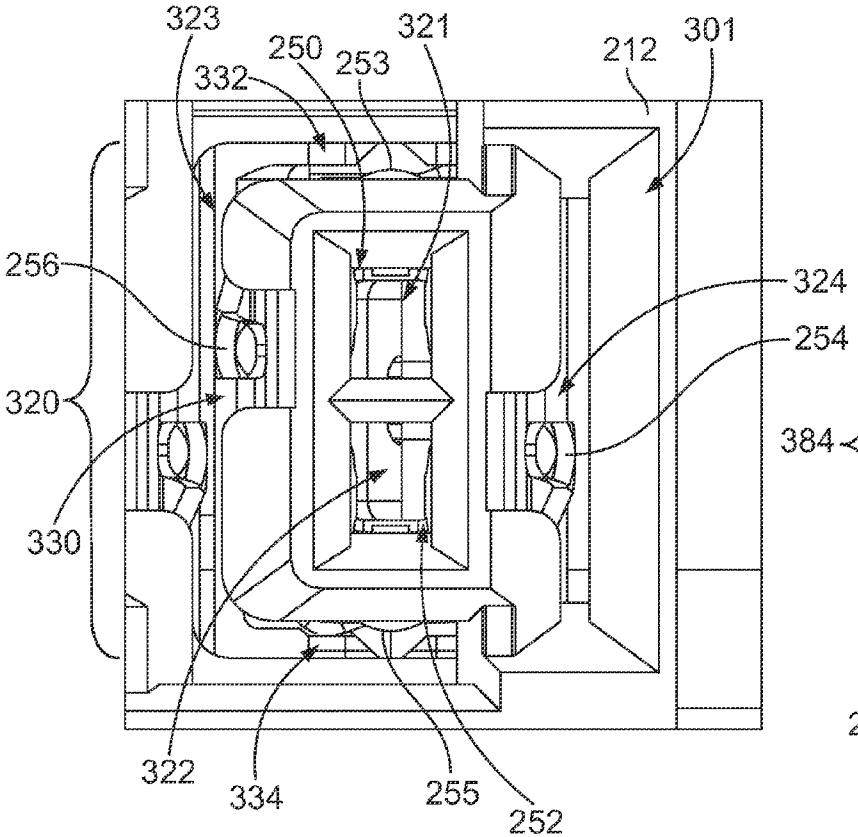
FIG. 12 is an enlarged view of contact passages aligned with signal members and ground members in accordance with one embodiment.

FIG. 12 is an enlarged view of a portion of the mating side 301 illustrating the signal members 250, 252 and the ground members 253-256 with respect to the passage sub-array 320. In FIG. 12, the signal members 250, 252 and the ground members 253-256 are located behind the connector shroud 212. As shown in FIG. 2, the signal members and the ground members are aligned with corresponding contact passages so that the signal and ground members will be engaged when the header and receptacle connectors 204, 206 (FIG. 2) are mated. More specifically, the ground member 253 is aligned with the leg portion 332 of the ground passage 323; the ground member 254 is aligned with the ground passage 324; the ground member 255 is aligned with the leg portion 334 of the ground passage 323; and the ground member 256 is aligned with the body portion 330 of the ground passage 323. The signal members 250, 252 are aligned with the signal passages 321, 322, respectively.

Figure 13:
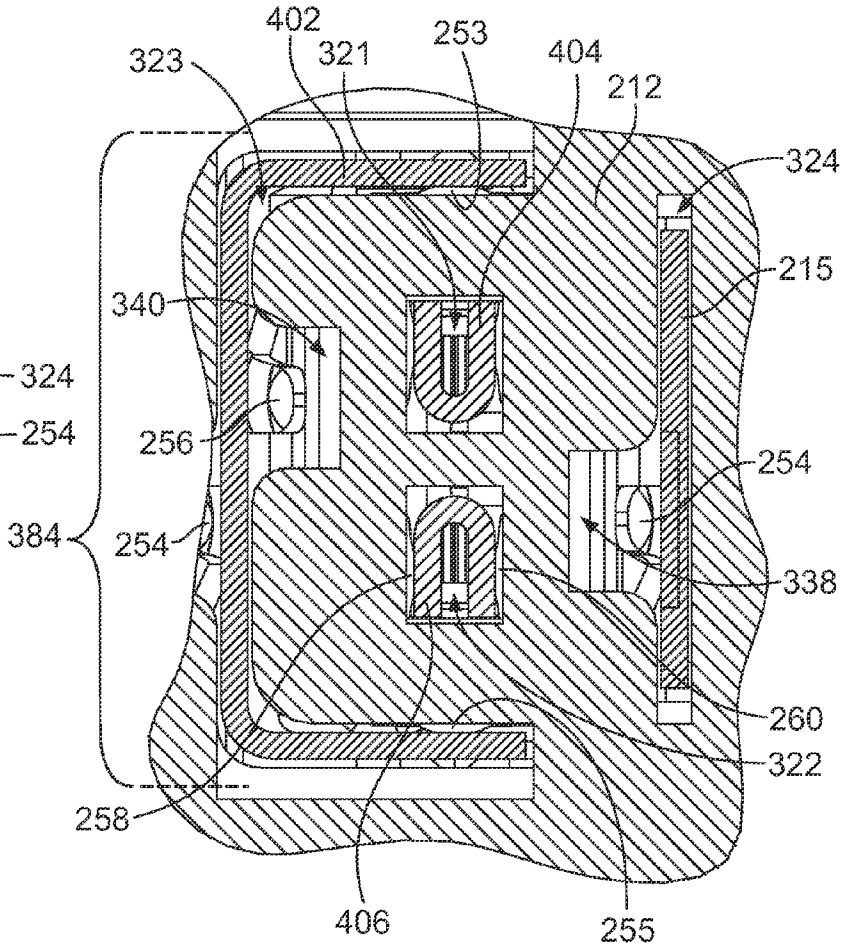
FIG. 13 is a cross-section of the electrical connector assembly illustrating the signal members and ground members engaged to corresponding features of the mating connector.

FIG. 13 is a cross-section of a portion of the connector shroud 212 taken transverse to the mating axis 216 (FIG. 2) when the header connector 204 (FIG. 2) and the receptacle connector 206 (FIG. 2) are mated. As shown, a ground shield 402 of the header connector 204 has been inserted into the ground passage 323 and one of the ground shields 215 has been inserted into the contact passage 324. Signal contacts 404, 406 of the header connector 204 have been inserted into the signal passages 321, 322, respectively. During the mating operation (in either of the first or second rotational positions), the receptacle connector 206 is advanced toward the header connector 204 along the mating axis 216. As the ground shield 402 is inserted into the ground passage 323, the ground shield 402 engages each of the ground members 253, 255, and 256. As the ground shield 215 is inserted into the ground passage 324, the ground shield 215 engages the ground member 254. In the illustrated embodiment, the ground shield 402 also engages the ground member 254 from the adjacent member sub-array. As shown, the ground members 254, 256 are deflected into the recesses 338, 340, respectively.

As the signal contacts 404, 406 are advanced into the signal passages 321, 322, each of the signal contacts 404, 406 engages the contact beams 258, 260 and deflects the contact beams 258, 260 away from each other. The contact beams 258, 260 may be biased to press against the corresponding signal contact 404, 406 and slide therealong as the signal contact is advanced into the corresponding signal passage. Likewise, the ground members 253-256 may be biased to press against the corresponding ground shield 215 or ground shield 402 of the header connector 204.

The ground shields 402, the ground shields 215, and the signal contacts 404, 406 of the header connector 204 may constitute a header sub-array 384. The header sub-array 384 is configured to engage one of the member sub-arrays 284 (FIG. 7) in either rotational position with the connector shroud 212 extending therebetween. However, it is noted that the header sub-array 384 may engage different member sub-arrays 284 in the different rotational positions.

As described herein, in some instances, the contact passage 324 may only exist along the exterior wall 304 (FIG. 11) of the connector shroud 212. More specifically, the passage sub-arrays 320 (FIG. 12) that are not along the exterior wall 304 may not include the contact passage 324. Nonetheless, due to the configuration of the communication array 240 (FIG. 6) and the member sub-arrays 284 (FIG. 8), the contact passage 324 may align with one of the ground members 254 in either of the rotational positions of the module assembly 217 (FIG. 2). As such, the header connector 204 is capable of mating with the receptacle connector 206 in either rotational position.

Thus, the passage array 307 and the individual passage sub-arrays 320 may also be characterized as having rotational symmetry relative to the communication array 240 such that the passages are capable of aligning with signal members and contact members before and after the connector shroud 212 is rotated. It is understood, however, that the signal members in the first rotational position may not be the same signal members in the second rotational position. Nonetheless, the configuration of the passage array 307 enables alignment of the signal members and the ground members with corresponding passages in either rotational position.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. In addition, in the following claims, the term "plurality" does not include each and every element that an object may have. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a module assembly including a contact module, the contact module having a module body and signal conductors held by the module body, the module assembly having a shroud-engaging face, wherein the signal conductors have respective signal members disposed along the shroud-engaging face; and a connector shroud coupled to the module assembly, the connector shroud having a mating side and an opposite loading side with a mating axis extending therebetween, the connector shroud including contact passages extending therethrough between the mating and loading sides, the loading side interfacing with the shroud-engaging face when the connector shroud is coupled to the module assembly, wherein the connector shroud couples to the module assembly in a first rotational position or in a second rotational position with respect to the mating axis, the contact passages aligning with the signal members for each of the first and second rotational positions.

2. The electrical connector of claim 1, wherein the contact passages form a passage array having a rotational symmetry in which the passage array has an effectively identical configuration for the first and second rotational positions.

3. The electrical connector of claim 1, wherein the module assembly includes a plurality of the contact modules stacked side-by-side, each of the contact modules having a mating edge, the mating edges collectively forming the shroud-engaging face.

4. The electrical connector of claim 1, wherein the contact module includes ground members disposed along the shroud-engaging face.

5. The electrical connector of claim 4, wherein the contact passages include signal passages and ground passages, the signal passages aligning with at least one of the signal members and the ground passages aligning with at least one of the ground members.

6. The electrical connector of claim 4, wherein the signal members and the ground members form a communication array including a plurality of member sub-arrays, each of the member sub-arrays including a differential pair of the signal members and a plurality of the ground members that are distributed around the pair of signal members.

7. The electrical connector of claim 1, wherein the contact module includes shroud-securing features and the connector shroud include module-securing features, the shroud-securing features and the module-securing features engaging each other to couple the connector shroud to the contact module.

8. An electrical connector comprising:

a module assembly including a plurality of signal members and ground members, the signal members being electrically coupled to signal conductors, the module assembly having a shroud-engaging face, wherein the ground members and the signal members are disposed along the shroud-engaging face and collectively form a communication array; and a connector shroud coupled to the module assembly, the connector shroud having a mating side and an opposite loading side with a mating axis extending therebetween, the connector shroud including contact passages extending therethrough between the mating and loading sides, the loading side interfacing with the shroud-engaging face when the connector shroud is coupled to the module assembly, wherein the connector shroud couples to the module assembly in a first rotational position or in a second rotational position with respect to the mating axis, the contact passages aligning with the signal members and the ground members of the communication array for each of the first and second rotational positions.

9. The electrical connector of claim 8, wherein the contact passages form a passage array having a rotational symmetry in which the passage array has an effectively identical configuration for the first and second rotational positions.

10. The electrical connector of claim 8, wherein the module assembly includes a plurality of the contact modules stacked side-by-side, each of the contact modules having a mating edge and including corresponding signal members and ground members that are disposed along the mating edge, the mating edges collectively forming the shroud-engaging face.

11. The electrical connector of claim 8, wherein the module assembly includes shroud-securing features and the connector shroud include module-securing features, the shroud-securing features and the module-securing features engaging each other to couple the connector shroud to the module assembly.

12. The electrical connector of claim 11, wherein the shroud-securing features include projections and the module-securing features include openings that are sized to receive the projections.

13. The electrical connector of claim 8, wherein the signal members are arranged to form signal pairs, each of the signal pairs being surrounded by a plurality of the ground members.

14. The electrical connector of claim 8, wherein the signal members and the ground members include contact beams that are disposed along the shroud-engaging face and are configured to be deflected between different positions.

15. The electrical connector of claim 8, wherein the communication array includes a plurality of member sub-arrays, each of the member sub-arrays including a pair of the signal members configured for differential signaling and a plurality of the ground members that are located around the pair of signal members.

16. An electrical connector comprising:

a connector shroud having a mating side and an opposite loading side with a mating axis extending therebetween; and a contact module comprising a module body and signal conductors held by the module body, the module body having a mating edge that interfaces with the loading side of the connector shroud and a mounting edge that is configured to engage a circuit board, the mating and mounting edges facing in substantially perpendicular directions, the signal conductors having respective signal members that are disposed along the mating edge;

wherein the contact module includes a plurality of shroud-securing features and the connector shroud includes a plurality of module-securing features that directly engage corresponding shroud-securing features, the shroud-securing features having a rotational symmetry such that an operative configuration of the shroud-securing features is substantially identical before and after the connector shroud is rotated 180° about the mating axis.

17. The electrical connector of claim 16, further comprising a plurality of the contact modules stacked side-by-side to form a module assembly, the mating edges of the contact modules collectively forming a shroud-engaging face that interfaces with the loading side of the connector shroud.

18. The electrical connector of claim 17, wherein the contact modules include ground members disposed along the mating edges, the signal members and the ground members of the contact modules forming a communication array.

19. The electrical connector of claim 18, wherein the communication array includes a plurality of member sub-arrays, each of the member sub-arrays including a pair of the signal members configured for differential signaling and a plurality of the ground members that are located around the pair of signal members.

20. The electrical connector of claim 16, wherein the shroud-securing features include projections and the module-securing features include openings that are sized to receive the projections.

* * * * *